US011235576B2

(12) United States Patent
Sekino et al.

(10) Patent No.: US 11,235,576 B2
(45) Date of Patent: Feb. 1, 2022

(54) LIQUID EJECTION DEVICE

(71) Applicant: Seiko Epson Corporation, Tokyo (JP)

(72) Inventors: Hirokazu Sekino, Chino (JP); Takeshi Seto, Shiojiri (JP); Hideki Kojima, Matsumoto (JP); Takahiro Matsuzaki, Shiojiri (JP); Yuji Saito, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/943,129

(22) Filed: Jul. 30, 2020

(65) Prior Publication Data

US 2021/0031520 A1 Feb. 4, 2021

(30) Foreign Application Priority Data

Jul. 31, 2019 (JP) ..... JP2019-140784

(51) Int. Cl.
*B41J 2/14* (2006.01)

(52) U.S. Cl.
CPC ..... *B41J 2/14233* (2013.01)

(58) Field of Classification Search
CPC . B41J 2/14233; B41J 2/025; B41J 2/01; B41J 2/14201
See application file for complete search history.

(56) References Cited

U.S. PATENT DOCUMENTS 3,997,111 A 12/1976 Thomas et al.
2009/0219320 A1* 9/2009 Shimizu ..... B41J 29/38 347/14

FOREIGN PATENT DOCUMENTS

CN 103417265 A 12/2013
JP S60-009199 B2 3/1985
JP H08-257997 A 10/1996

OTHER PUBLICATIONS

IP.com search (Year: 2020).*

* cited by examiner

*Primary Examiner* — Lisa Solomon
(74) *Attorney, Agent, or Firm* — Harness, Dickey & Pierce, P.L.C.

(57) ABSTRACT

A liquid ejection device includes: a nozzle through which a liquid is ejected; a liquid transfer tube through which the liquid is transferred to the nozzle; and a vibration generation unit configured to generate vibration, in which the vibration generation unit is in contact with one of the liquid, the nozzle, and the liquid transfer tube, and when the liquid ejected from the nozzle flies as a plurality of droplets in a state where the vibration generation unit does not generate vibration, and the number of the droplets passing through a predetermined position in a unit time is defined as a droplet frequency, a frequency of the vibration generated by the vibration generation unit is equal to or less than the droplet frequency.

7 Claims, 8 Drawing Sheets

LIQUID EJECTION DEVICE

The present application is based on, and claims priority from JP Application Serial Number 2019-140784, filed Jul. 31, 2019, the disclosure of which is hereby incorporated by reference herein in its entirety.

BACKGROUND

1. Technical Field

The present disclosure relates to a liquid ejection device.

2. Related Art

There has been a liquid ejection device that performs operations such as cleaning, deburring, peeling, and trimming on an operation target by ejecting a pressurized liquid from a nozzle to collide with the operation target.

For example, JP-A-08-257997 discloses a method of processing a material or the like in which gas is mixed into a liquid pressurized at a high pressure and ejected from a nozzle, so as to collide with a target as a droplet since an ejected flow structure is collapsed. When the droplet is collided with an operation target in this manner, an erosion amount per unit time with respect to a surface of the target can be further increased.

An erosion action by the droplet, that is, the erosion amount per droplet when the ejected liquid, as the droplet, collides with the operation target, can be quantified by an impact pressure and a droplet diameter.

The impact pressure is determined by a liquid ejection flow rate and a nozzle diameter. Specifically, in order to increase the impact pressure, it is necessary to increase the ejection flow rate or reduce the nozzle diameter to increase a droplet speed. However, when the ejection flow rate is increased, a large amount of the ejected liquid is scattered, a visibility is deteriorated, and peripheral devices are adversely affected. Then, there is a problem that operation efficiency is reduced.

Therefore, it is considered to reduce the nozzle diameter. However, the operation efficiency by the droplet depends on the droplet diameter as described above. As the droplet diameter increases, the operation efficiency can be increased more efficiently.

However, when the nozzle diameter is reduced as described above, the droplet diameter is reduced accordingly. As a result, a contribution to the operation efficiency due to the droplet diameter is reduced, and the operation efficiency cannot be sufficiently increased.

SUMMARY

A liquid ejection device according to an application example of the present disclosure includes: a nozzle through which a liquid is ejected; a liquid transfer tube through which the liquid is transferred to the nozzle; and a vibration generation unit configured to generate vibration, in which the vibration generation unit is in contact with any one of the liquid, the nozzle, and the liquid transfer tube, and when the liquid ejected from the nozzle flies as a plurality of droplets in a state where the vibration generation unit does not generate vibration, and the number of the droplets passing through a predetermined position in a unit time is defined as a droplet frequency, a frequency of the vibration generated by the vibration generation unit is equal to or less than the droplet frequency.

DESCRIPTION OF EXEMPLARY EMBODIMENTS

Hereinafter, preferred embodiments of a liquid ejection device according to the present disclosure will be described in detail with reference to the accompanying drawings.

1. First Embodiment

First, a liquid ejection device according to a first embodiment will be described.

Figure 1:
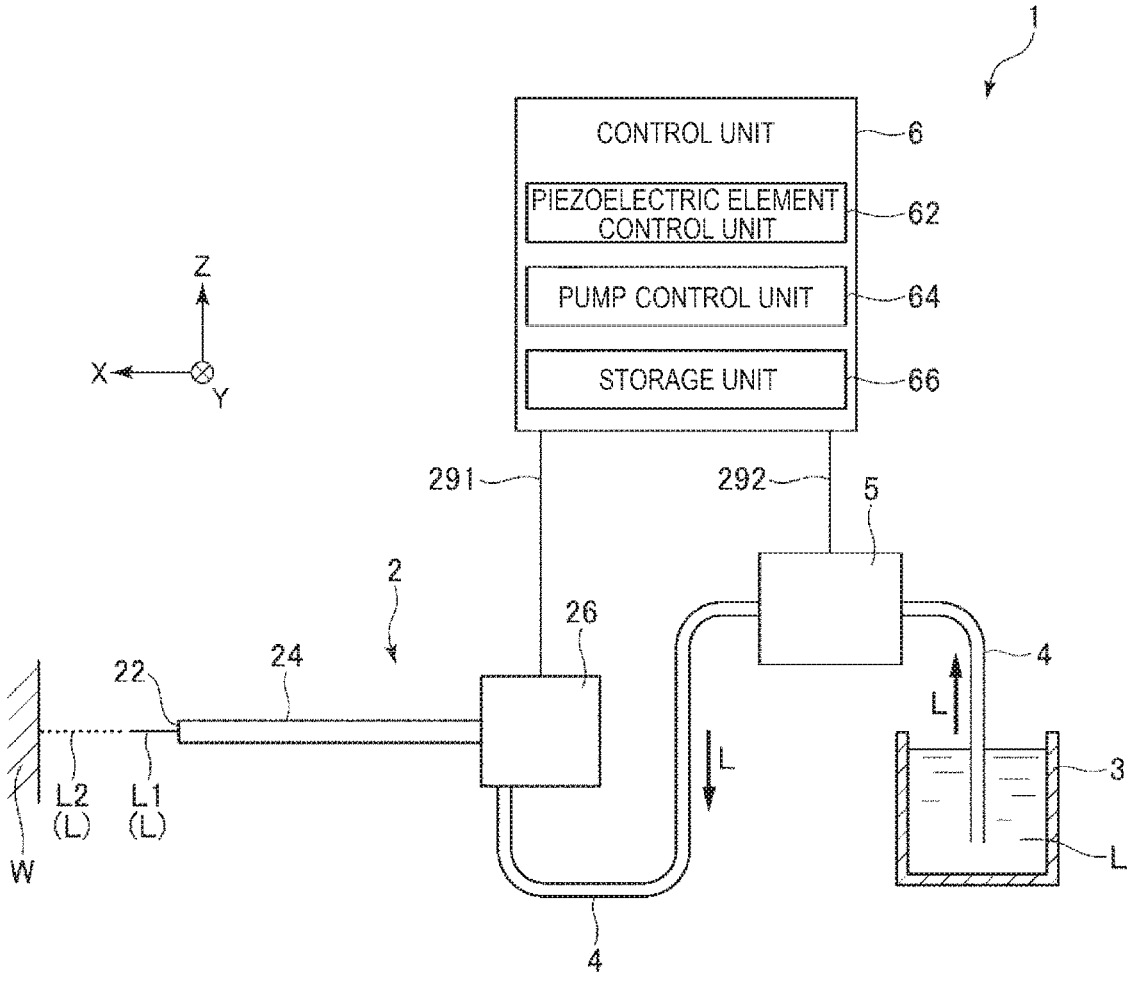
FIG. 1 is a conceptual diagram showing a liquid ejection device according to a first embodiment.
Figure 2:
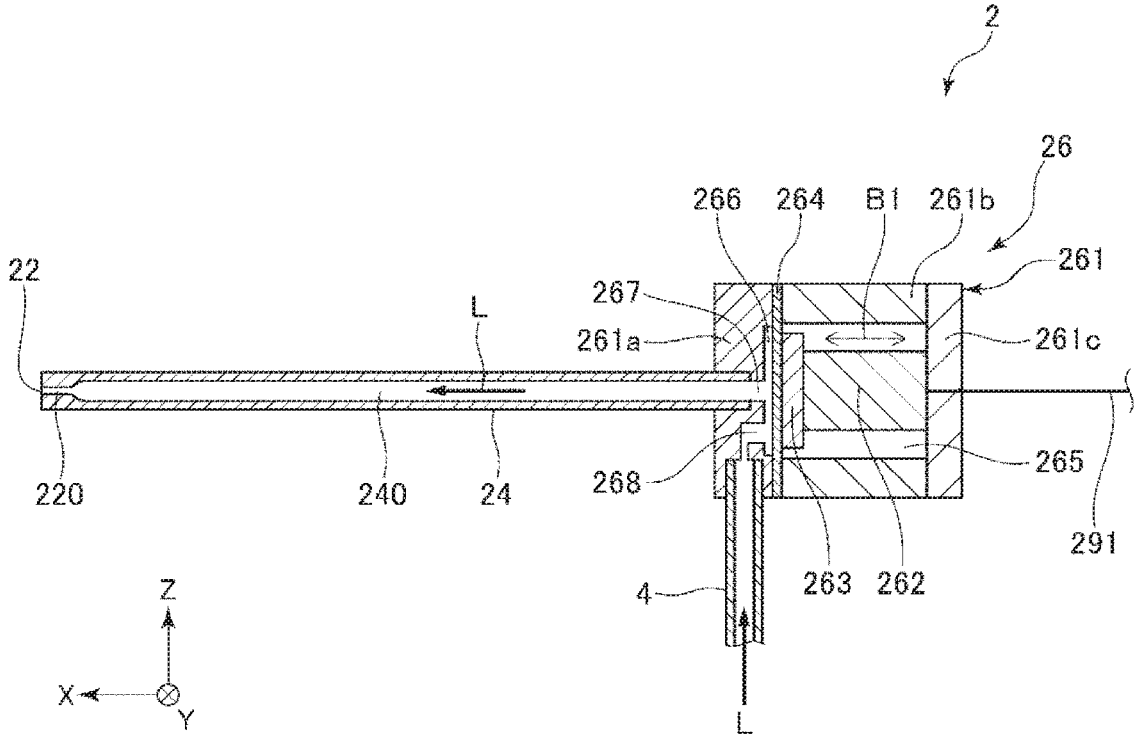
FIG. 2 is a cross-sectional view showing a nozzle unit of the liquid ejection device shown in FIG. 1.

FIG. 1 is a conceptual diagram showing a liquid ejection device according to the first embodiment. FIG. 2 is a cross-sectional view showing a nozzle unit of the liquid ejection device shown in FIG. 1.

A liquid ejection device 1 shown in FIG. 1 includes a nozzle unit 2, a liquid container 3 that stores a liquid L, a liquid supplying tube 4 that links the nozzle unit 2 and the liquid container 3, a liquid feeding pump 5, and a control unit 6. Such a liquid ejection device 1 performs various operations by ejecting the liquid L from the nozzle unit 2 and causing the liquid L to collide with an operation target W. Examples of the various operations include cleaning, deburring, peeling, and trimming.

Hereinafter, each unit of the liquid ejection device 1 will be described in detail.

1.1 Nozzle Unit

As shown in FIG. 2, the nozzle unit 2 includes a nozzle 22, a liquid transfer tube 24, and a vibration generation unit 26. Among these parts, the nozzle 22 ejects the liquid L towards the operation target W. The liquid transfer tube 24 is a channel that links the nozzle 22 and the vibration generation unit 26. The liquid transfer tube 24 transfers the liquid L from the vibration generation unit 26 to the nozzle 22. Further, the vibration generation unit 26 applies vibration as indicated by an arrow B1 to the liquid L supplied from the liquid container 3 via the liquid supplying tube 4. By applying the vibration to the liquid L in this manner, a pressure of the liquid L ejected from the nozzle 22 periodically varies. Accordingly, when the liquid L ejected from the nozzle 22 becomes a droplet L2, the droplet L2 having a larger diameter is formed. As a result, an erosion amount per droplet can be increased by increasing the diameter of the droplet L2.

For the convenience of description, an axis linking the nozzle 22 and the operation target W is defined as an X axis, and an axis that is orthogonal to the X axis and is an axis of the liquid supplying tube 4 in a vicinity of a portion linked to the vibration generation unit 26 is defined as a Z axis in the drawings of the present application. An axis orthogonal to both the X axis and the Z axis is defined as a Y axis. In the X axis, a direction from the nozzle 22 towards the operation target W is defined as an X-axis positive side or a tip end side, and an opposite direction is defined as an X-axis negative side or a base end side. Further, in the Z axis, a direction from the liquid supplying tube 4 towards the liquid transfer tube 24 is defined as a Z-axis positive side, and an opposite direction is defined as a Z-axis negative side.

Hereinafter, each part of the nozzle unit 2 will be described in detail.

The nozzle 22 is attached to a tip end portion of the liquid transfer tube 24. The nozzle 22 is internally provided with a nozzle channel 220 through which the liquid L passes. An inner diameter of a tip end portion of the nozzle channel 220 is smaller than an inner diameter of a base end portion of the nozzle channel 220. The liquid L transferred towards the nozzle 22 in the liquid transfer tube 24 is formed into a fine flow via the nozzle channel 220 and is ejected. The nozzle 22 shown in FIG. 2 may be a member different from the liquid transfer tube 24, or may be integrally formed with the liquid transfer tube 24.

The liquid transfer tube 24 is a tube that links the nozzle 22 and the vibration generation unit 26, and includes a liquid channel 240 that transfers the liquid L in the liquid transfer tube 24. The above nozzle channel 220 communicates with the liquid supplying tube 4 via the liquid channel 240. The liquid transfer tube 24 may be a straight tube or a curved tube.

The nozzle 22 and the liquid transfer tube 24 only need to have such rigidity that the nozzle 22 and the liquid transfer tube 24 do not deform when the liquid L is ejected. Examples of a constituent material of the nozzle 22 include a metal material, a ceramic material, and a resin material. Examples of a constituent material of the liquid transfer tube 24 include a metal material and a resin material, and the metal material is particularly preferably used.

An inner diameter of the nozzle channel 220 is appropriately selected according to an operation content, a material of the operation target W, and the like, and is preferably, for example, 0.05 mm or more and 1.0 mm or less, and more preferably 0.10 mm or more and 0.30 mm or less.

The vibration generation unit 26 includes a housing 261, a piezoelectric element 262 and a reinforcing plate 263 provided in the housing 261, and a diaphragm 264.

The housing 261 has a box shape, and includes each part of a first case 261*a*, a second case 261*b*, and a third case 261*c*. Each of the first case 261*a* and the second case 261*b* has a cylindrical shape including a through hole penetrating from a base end to a tip end. The diaphragm 264 is interposed between an opening of the first case 261*a* on a base end side and an opening of the second case 261*b* on a tip end side. The diaphragm 264 is, for example, a film-shaped member having elasticity or flexibility.

The third case 261*c* has a plate shape. The third case 261*c* is fixed to an opening of the second case 261*b* on the base end side. Space formed by the second case 261*b*, the third case 261*c*, and the diaphragm 264 is an accommodation chamber 265. The accommodation chamber 265 accommodates the piezoelectric element 262 and the reinforcing plate 263. A base end of the piezoelectric element 262 is linked to the third case 261*c*, and a tip end of the piezoelectric element 262 is linked to the diaphragm 264 via the reinforcing plate 263.

The through hole of the first case 261*a* penetrates from the base end to the tip end. Such a through hole includes an area on the base end side having a relatively large inner diameter and an area on the tip end side having a relatively small inner diameter. Among the areas, the liquid transfer tube 24 is inserted into the area having the small inner diameter from an opening on the tip end side. In the area where the inner diameter is large, the diaphragm 264 is covered from the base end side. Space formed by the area having a large inner diameter and the diaphragm 264 is a liquid chamber 266.

Further, space between the liquid chamber 266 and the liquid transfer tube 24 is an outlet channel 267. On the other hand, an inlet channel 268 which is different from the outlet channel 267 communicates with the liquid chamber 266. One end of the inlet channel 268 communicates with the liquid chamber 266, and the other end thereof is inserted with the liquid supplying tube 4 described above from the Z-axis negative side. Accordingly, an internal channel of the liquid supplying tube 4 communicates with the inlet channel 268, the liquid chamber 266, the outlet channel 267, the liquid channel 240, and the nozzle channel 220. As a result, the liquid L supplied to the inlet channel 268 via the liquid supplying tube 4 is sequentially ejected through the liquid chamber 266, the outlet channel 267, the liquid channel 240, and the nozzle channel 220.

A wiring 291 is drawn out from the piezoelectric element 262 via the housing 261. The piezoelectric element 262 is electrically linked to the control unit 6 via the wiring 291. The piezoelectric element 262 vibrates so as to expand or contract along the X axis based on an inverse piezoelectric effect by a drive signal supplied from the control unit 6. When the piezoelectric element 262 expands, the diaphragm 264 is pushed to the X-axis positive side. Therefore, a volume of the liquid chamber 266 is decreased and a pressure in the liquid chamber 266 is raised. Then, the liquid L in the liquid chamber 266 is sent to the outlet channel 267, and the liquid L in the nozzle channel 220 is ejected. On the other hand, when the piezoelectric element 262 contracts, the diaphragm 264 is pulled toward the X-axis negative side. Therefore, the volume of the liquid chamber 266 is enlarged, and the pressure in the liquid chamber 266 is reduced. Then, the liquid L in the inlet channel 268 is sent into the liquid chamber 266.

As in the present embodiment, by providing the vibration generation unit 26 inside the nozzle unit 2 and generating such vibration in an ejection direction of the liquid L, the ejection direction of the liquid L is less likely to be deviated from the X axis. That is, even if a pulsation flow is generated in the liquid L due to the vibration generated by the vibration generation unit 26, a component along the Y axis or a component along the Z axis is less likely to be included in the ejection direction of the liquid L. Therefore, accuracy of a flight path of the droplet L2 becomes high, and accuracy of an operation range is also easily increased. As a result, it is possible to increase operation efficiency in this point of view.

A vibration pattern of the piezoelectric element 262 may be a periodic pattern or a non-periodic pattern as long as it is a vibration pattern that can displace the diaphragm 264 along the X axis. When the vibration pattern is a periodic pattern, a frequency of the variation pattern may be constant or may vary. The piezoelectric element 262 may be an element that expands, contracts and vibrates along the X axis, or may be an element that flexes and vibrates.

The piezoelectric element 262 includes, for example, a piezoelectric body and an electrode provided on the piezoelectric body. Examples of a constituent material of the piezoelectric body include piezoelectric ceramics such as lead zirconate titanate (PZT), barium titanate, lead titanate, potassium niobate, lithium niobate, lithium tantalate, sodium tungstate, zinc oxide, barium strontium titanate (BST), strontium bismuth tantalate (SBT), lead metaniobate, and lead scandium niobate.

The piezoelectric element 262 can be replaced with any element or mechanical element that can displace the diaphragm 264. Examples of such an element or a mechanical element include a magnetostrictive element, an electromagnetic actuator, and a combination of a motor and a cam.

The housing 261 only needs to have such rigidity that the housing 261 does not deform when the pressure in the liquid chamber 266 is raised or reduced.

The vibration generation unit 26 shown in FIG. 2 is provided at a base end portion of the liquid transfer tube 24, but a position of the vibration generation unit 26 is not particularly limited. For example, the vibration generation unit 26 may be provided in the middle of the liquid transfer tube 24.

1.2 Liquid Container

The liquid container 3 stores the liquid L. The liquid L stored in the liquid container 3 is supplied to the nozzle unit 2 via the liquid supplying tube 4.

As the liquid L, for example, water is preferably used, but an organic solvent may be used. Any solute may be dissolved in the water or the organic solvent, and any dispersoid may be dispersed in the water or the organic solvent.

The liquid container 3 may be a sealed container or an open container.

1.3 Liquid Feeding Pump

The liquid feeding pump 5 is provided in the middle or an end portion of the liquid supplying tube 4. The liquid L stored in the liquid container 3 is suctioned by the liquid feeding pump 5 and supplied to the nozzle unit 2 at a predetermined flow rate.

The control unit 6 which will be described later is electrically linked to the liquid feeding pump 5 via a wiring 292. The liquid feeding pump 5 has a function of changing a flow rate of the liquid L to be supplied based on a drive signal output from the control unit 6.

The liquid feeding pump 5 may include a built-in check valve as necessary. By providing such a check valve, it is possible to prevent the liquid L from flowing back through the liquid supplying tube 4 accompanied by the vibration applied to the liquid L in the vibration generation unit 26. The check valve may be provided independently in the middle of the liquid supplying tube 4.

1.4 Control Unit

The control unit 6 is electrically linked to the nozzle unit 2 via the wiring 291. The control unit 6 is electrically linked to the liquid feeding pump 5 via the wiring 292.

The control unit 6 shown in FIG. 1 includes a piezoelectric element control unit 62, a pump control unit 64, and a storage unit 66.

The piezoelectric element control unit 62 outputs a drive signal to the piezoelectric element 262. Driving of the piezoelectric element 262 is controlled by the drive signal. Accordingly, the diaphragm 264 can be displaced by, for example, a predetermined frequency and a predetermined displacement amount.

The pump control unit 64 outputs a drive signal to the liquid feeding pump 5. Driving of the liquid feeding pump 5 is controlled by the drive signal. Accordingly, the liquid L can be supplied to the nozzle unit 2 at, for example, a predetermined flow rate and a predetermined drive time.

The control unit 6 can control the driving of the liquid feeding pump 5 and the driving of the piezoelectric element 262 in cooperation with each other.

Functions of the control unit 6 are implemented by hardware such as an arithmetic unit, a memory, and an external interface.

Examples of the arithmetic unit include a central processing unit (CPU), a digital signal processor (DSP), and an application specific integrated circuit (ASIC).

Examples of the memory include a read only memory (ROM), a flash ROM, a random access memory (RAM), and a hard disk.

1.5 Operation of Liquid Ejection Device

Next, an operation of the liquid ejection device 1 will be described.

The liquid L stored in the liquid container 3 is suctioned by the liquid feeding pump 5 and supplied to the vibration generation unit 26 at a predetermined flow rate via the liquid supplying tube 4. In the vibration generation unit 26, the pressure of the liquid L supplied to the liquid chamber 266 varies. The pressure variability causes the liquid L to generate a pulsation flow. The pulsation flow refers to the flow of the liquid L whose flow rate or flow speed varies with time. A varying pattern may be a regular pattern or an irregular pattern. The liquid L accompanied by the pulsation flow is ejected through the liquid channel 240 and the nozzle channel 220 shown in FIG. 2.

Figure 3:
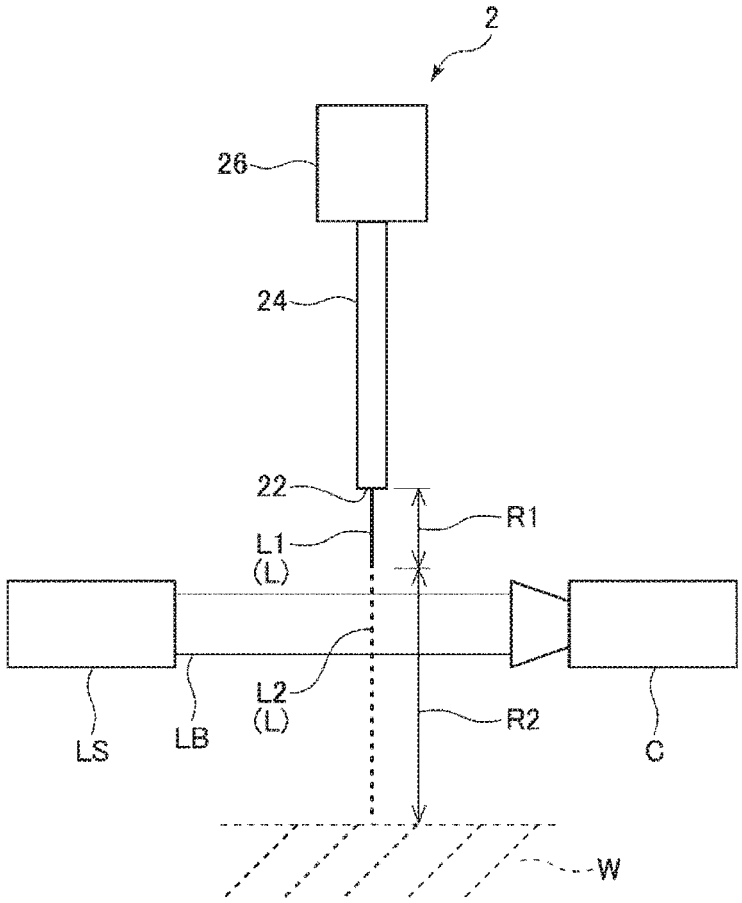
FIG. 3 is a side view schematically showing a shape of a liquid ejected from the liquid ejection device.

The liquid L ejected from the liquid ejection device 1 as described above flies in the air while showing a behavior as shown in FIG. 3, for example. FIG. 3 is a side view schematically showing a shape of the liquid L ejected from the liquid ejection device 1.

The liquid L ejected from the liquid ejection device 1 flies as the continuous columnar ejected flow L1 immediately after the ejection. Such a continuous ejected flow L1 is generated in an area within a predetermined distance from a tip end of the nozzle 22. This area is referred to as a "continuous flow area R1". On the other hand, a state of the continuous ejected flow L1 is changed into the droplet L2 on an operation target W side from the continuous flow area R1. An area where the droplet L2 is generated is referred to as a "droplet flow area R2". When the droplet L2 generated in this manner collides with the operation target W, the impact pressure can be increased even at the same flow rate as compared with a case in which the ejected flow L1 collides with the operation target W. As a result, the operation efficiency can be increased.

Figure 4:
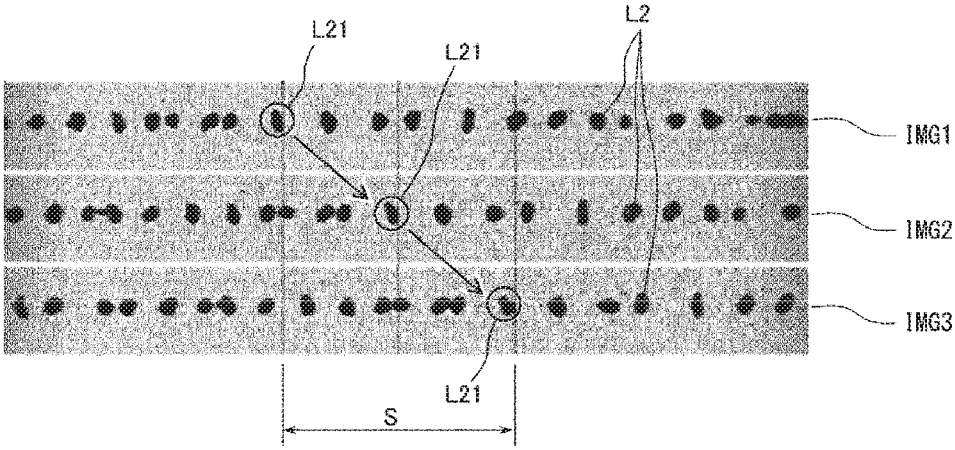
FIG. 4 is an example of images obtained when a droplet flow area is imaged by a high-speed camera.

Here, when the droplets L2 in the droplet flow area R2 are observed at any time point, as shown in FIG. 4, a state in which a large number of droplets L2 are linearly arranged at a predetermined interval can be seen. FIG. 4 is an example of images obtained when the droplet flow area R2 is imaged by a high-speed camera C shown in FIG. 3. The high-speed camera C shown in FIG. 3 images light LB emitted from a lighting section LS toward the liquid droplet flow area R2. Accordingly, in the obtained images, the light LB which is a background and the droplets L2 blocking the light LB are shown. FIG. 4 shows an example of three images IMG1, IMG2, and IMG3 obtained by imaging the droplet flow area R2 at a constant time interval while the high-speed camera C is fixed. In FIG. 4, the droplet L2 is shown in a dark color and the background is shown in a light color. When the images shown in FIG. 4 are imaged, the piezoelectric element 262 of the vibration generation unit 26 is not driven.

As shown in FIG. 4, the liquid L ejected from the liquid ejection device 1 becomes the droplets L2 in the droplet flow area R2 positioned at a predetermined distance from the tip end of the nozzle 22. In this area, as shown in FIG. 4, the droplets L2 are linearly arranged. Here, attention is paid to one droplet L21 in the image IMG1. The droplet L21 is moved to a right side from a position of the image IMG1 in the image IMG2 which is imaged after a unit time since the image IMG1 is imaged. Further, the droplet L21 is moved to a right side from a position of the image IMG2 in the image IMG3 which is imaged after the unit time since the image IMG2 is imaged.

From the three images described above, a moving distance S of the droplet L21 and a time t required for the movement of the moving distance S can be obtained. Then, a flying speed of the droplet L21 can be calculated based on the moving distance S and the required time t. The flying speed of the droplet L21 can be regarded as a flying speed V of the droplet L2.

In addition, since a plurality of droplets L2 forming a column is shown in each image, these intervals can be measured. Then, an average value of pitches is obtained from the measured intervals, and the value is set as a pitch p between the droplets L2. Then, it is possible to calculate the number of the droplets L2 passing through a predetermined position in the unit time by dividing the pitch p by the flying speed V. This value is set to "droplet frequency fL". Since the droplet frequency fL is a value when the piezoelectric element 262 of the vibration generation unit 26 is not driven, it can be said that the droplet frequency fL is a value unique to the nozzle 22 and ejection conditions of the liquid L.

Further, an area of a projected image of the droplet L2 can be obtained from each image. Therefore, a projection area of the droplet L2 is calculated, and a radius of a sphere having the same projection area as the calculated projection area is calculated. An average value of the radius of the sphere is defined as a droplet diameter d. In the calculation of the projection area, the image shown in FIG. 4 can be subjected to an image processing such as binarization, and the projection area can be calculated based on the number of pixels exhibiting the dark color.

As described above, the droplet frequency fL and the droplet diameter d of the droplets L2 can be obtained.

Meanwhile, in the liquid ejection device 1, as described above, the inner diameter of the nozzle channel 220 is made as small as possible, and in contrary to this, the droplet diameter d is required to be increased. Accordingly, the operation efficiency when the droplets L2 collide with the operation target W can be increased.

Therefore, the present inventor conducted intensive studies on a method of increasing the droplet diameter d without changing the inner diameter of the nozzle channel 220. Then, the present inventor pays attention to a relationship between a drive frequency fD and the droplet frequency fL when the piezoelectric element 262 vibrates the diaphragm 264. In addition, the present inventor finds that the droplet diameter d can be increased without increasing an ejection flow rate of the liquid L by setting the drive frequency fD to be equal to or less than the droplet frequency fL, and the present disclosure is completed in this way.

That is, the liquid ejection device 1 according to the present embodiment includes the nozzle 22 through which the liquid L is ejected, the liquid transfer tube 24 through which the liquid L is transferred to the nozzle 22, and the vibration generation unit 26 that generates the vibration. Then, the diaphragm 264 of the vibration generation unit 26 shown in FIG. 2 is in contact with the liquid L and applies the vibration to the liquid L. In a state in which the vibration generation unit 26 does not generate the vibration, the liquid L ejected from the nozzle 22 flies as a plurality of droplets L2, and the number of the droplets L2 passing through the predetermined position in the unit time is defined as the droplet frequency fL. At this time, the drive frequency fD, which is a frequency of the vibration generated by the vibration generation unit 26, is equal to or less than the droplet frequency fL.

By optimizing the drive frequency fD in this way, the droplet diameter d can be increased without changing the inner diameter of the nozzle channel 220. Therefore, the erosion amount per unit time can be increased without reducing the flying speed of the droplets L2. As a result, the operation efficiency accompanied by the collision of the droplets L2 can be increased.

By optimizing the drive frequency fD as described above, the operation efficiency can be increased without increasing the ejection flow rate of the liquid L. Therefore, it is possible to prevent the increasing of the ejection flow rate, and to prevent problems that are generated when the flow rate of the ejected liquid L is large, for example, a large amount of scattered liquid L deteriorates the visibility around the operation target W, interferes the operation, and adversely affects the peripheral devices. As a result, it is possible to increase the operation efficiency in this point of view.

It is considered that such an effect is caused when the columnar ejected flow L1 ejected from the nozzle 22 is easily divided by the pulsation flow generated in the liquid chamber 266. At this time, it is considered that an interval between a constriction generated in the columnar ejected flow L1 becomes long and a size of the droplet L2 becomes large by adjusting and optimizing the drive frequency fD to be equal to or less than the droplet frequency fL.

Figure 5:
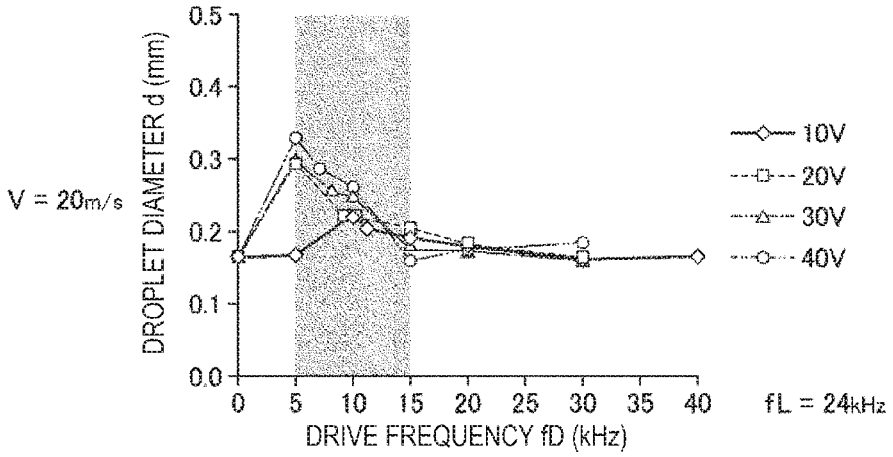
FIG. 5 is a graph showing a relationship between a drive frequency and a droplet diameter when a piezoelectric element shown in FIG. 2 is driven at the drive frequency.
Figure 6:
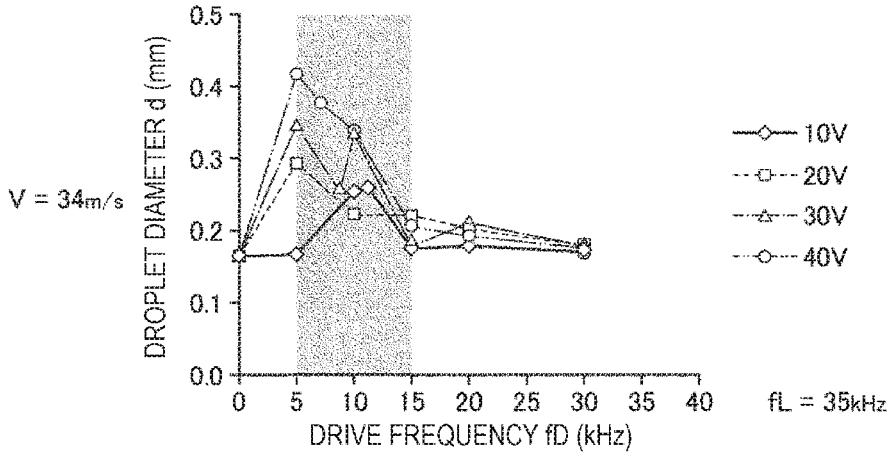
FIG. 6 is a graph showing a relationship between a drive frequency and a droplet diameter when the piezoelectric element shown in FIG. 2 is driven at the drive frequency.
Figure 7:
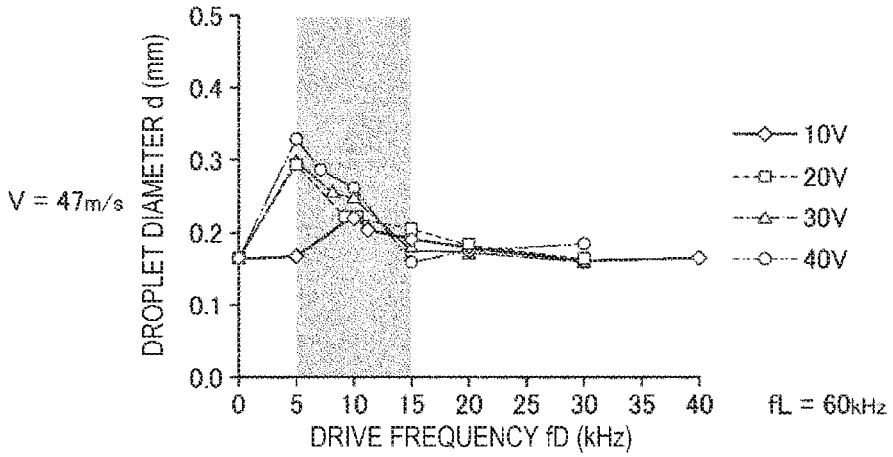
FIG. 7 is a graph showing a relationship between a drive frequency and a droplet diameter when the piezoelectric element shown in FIG. 2 is driven at the drive frequency.
Figure 8:
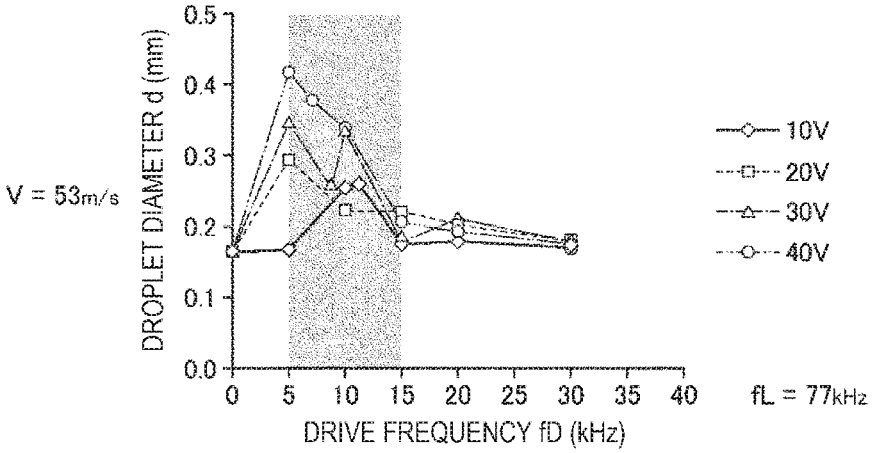
FIG. 8 is a graph showing a relationship between a drive frequency and a droplet diameter when the piezoelectric element shown in FIG. 2 is driven at the drive frequency.

FIGS. 5 to 8 are graphs showing a relationship between the drive frequency fD and the droplet diameter d when the piezoelectric element 262 shown in FIG. 2 is driven at the drive frequency fD when the inner diameter of the nozzle channel 220 is 0.15 mm, the liquid L is fed at each flow rate of 20 ml/min, 30 ml/min, 40 ml/min, and 50 ml/min, and the liquid L is ejected. FIG. 5 is a graph when the flying speed V is 20 m/s. FIG. 6 is a graph when the flying speed V is 34 m/s. FIG. 7 is a graph when the flying speed V is 47 m/s. FIG. 8 is a graph when the flying speed V is 53 m/s. In FIGS. 5 to 8, data when a voltage of the drive signal applied to the piezoelectric element 262 is changed among four levels is shown in an overlapping manner. Voltages 10 V, 20 V, 30 V, and 40 V shown in FIGS. 5 to 8 indicate voltages of drive signals. In FIGS. 5 to 8, the droplet frequency fL in corresponding to each flying speed V is also shown.

As is apparent from such a graph, by setting the drive frequency fD to be equal to or less than the droplet frequency fL, a maximum value of the droplet diameter d can be found in the range. Therefore, it is recognized that the droplet diameter d can be enlarged more greatly as compared with a case where the drive frequency fD exceeds the droplet frequency fL. Accordingly, the operation efficiency accompanied by the collision of the droplet L2 can be increased.

In particular, the drive frequency fD, which is the frequency of the vibration generated by the vibration generation unit 26 and applied to the liquid L, is preferably 5% or more and 50% or less, and more preferably 7% or more and 40% or less of the droplet frequency fL. By setting the drive frequency fD within such a range, the droplet diameter d can be more reliably enlarged. Therefore, the operation efficiency accompanied by the collision of the droplets L2 can be more reliably increased.

For example, when the drive frequency fD is 50% or less of the droplet frequency fL, the droplet diameter d can be enlarged to twice or more in calculation, compared with when the drive frequency fD is zero. Here, it is known that the erosion amount per droplet accompanied by the collision of the droplet L2 is proportional to 4.67 power of the droplet diameter d. Therefore, when the droplet diameter d can be enlarged twice by applying the vibration to the liquid L while maintaining the flow rate at which the liquid is fed constant, the droplet frequency fL is theoretically decreased to ⅛ (one over 3 power of 2) by increasing a volume of the droplet L2 by eight times. At this time, the erosion amount per unit time can be increased to about 3.2 ((4.67 power of 2)/8) times as compared with when no vibration is applied.

Thus, if the droplet diameter d can be enlarged, the erosion amount per unit time can be more effectively increased.

Data shown in FIGS. 5 to 8 is data when the piezoelectric element 262 is a stacked piezoelectric element and a signal having a sinusoidal waveform is input as the drive signal. However, in the present disclosure, a form of the piezoelectric element 262 and the waveform of the drive signal are not limited thereto. For example, the waveform of the drive signal may be a rectangular wave, a sawtooth wave, or any other waveform.

The drive frequency fD, which is the frequency of the vibration generated by the vibration generation unit 26 and applied to the liquid L, is preferably 5 kHz or more and 15 kHz or less, and more preferably 5 kHz or more and 10 k Hz or less. Such a frequency band is a frequency band in which the droplet diameter d can be enlarged regardless of the flying speed V of the droplet L2. Therefore, by setting the drive frequency fD in this frequency band, even when the flow rate by the liquid feeding pump 5 is changed, it is possible to enlarge the droplet diameter d with high probability. As a result, the operation efficiency accompanied by the collision of the droplets L2 can be more reliably increased.

In view of data shown in FIGS. 5 to 8, when the drive frequency fD is optimized, the droplet diameter d can be enlarged by 50% or more as compared with the case where the drive frequency fD is 0. Therefore, the erosion amount per unit time when the droplets L2 collide with the operation target W can be increased to about 2.0 times. Therefore, in the present embodiment, a great effect can be obtained with a relatively simple operation of optimizing the drive frequency fD.

When the drive frequency fD is zero, the droplet diameter d cannot be sufficiently increased, and therefore, the operation efficiency cannot be sufficiently improved. On the other hand, when the drive frequency fD exceeds the droplet frequency fL, the droplet diameter d cannot be sufficiently increased either, and therefore the operation efficiency cannot be sufficiently improved.

As described above, the droplet frequency fL can be obtained from the pitch p and the flying speed V of the droplet L2. These parameters are both correlated with known conditions such as the flow rate of the liquid L, the inner diameter of the nozzle channel 220, and a density of the liquid L. Therefore, by preparing a conversion formula, a conversion table, or the like for obtaining the droplet frequency fL in advance from these conditions, the droplet frequency fL can be easily obtained. The conversion formula and conversion table necessary for conversion may be stored in the storage unit 66 of the control unit 6.

As described above, the vibration pattern of the vibration generated by the vibration generation unit 26 is not limited. On the other hand, in FIG. 2, the vibration generation unit 26 generates the vibration for the liquid L in a transfer direction of the liquid L in the liquid transfer tube 24. That is, a displacement direction of the diaphragm 264 by the vibration generation unit 26 shown in FIG. 2 is a direction along the X axis. Accordingly, the vibration generation unit 26 generates a vibration that causes the liquid L to pulsate in the transfer direction of the liquid L.

When the vibration generation unit 26 generates such a vibration, the ejection direction of the liquid L is less likely to be deviated from the X axis. That is, even if the liquid L is accompanied by the pulsation flow due to the vibration generated by the vibration generation unit 26, the component along the Y axis or the component along the Z axis is less likely to be included in the ejection direction of the liquid L. Therefore, the accuracy of the flight path of the droplet L2 becomes high, and the accuracy of the operation range is also easily increased. As a result, it is possible to increase the operation efficiency in this point of view.

The voltage of the drive signal input to the piezoelectric element 262 is slightly different according to a configuration of the piezoelectric element 262, but is preferably 1 V or more and 100 V or less, and more preferably 10 V or more and 40 V or less. Accordingly, since the piezoelectric element 262 vibrates at necessary and sufficient amplitude, the droplets L2 can be generated more stably.

As described above, the vibration generation unit may include the mechanical element other than the piezoelectric element 262, but the vibration generation unit 26 shown in FIG. 2 includes the piezoelectric element 262. The piezoelectric element 262 can efficiently convert an electric signal into mechanical vibration with a small time lag. Therefore, accuracy in controlling the drive frequency fD can be easily increased, and as a result, the operation efficiency can be relatively easily increased. The piezoelectric element 262 can be easily made smaller than other mechanical element. Therefore, the piezoelectric element 262 contributes to reducing a size of the liquid ejection device 1.

2. Second Embodiment

Next, a liquid ejection device according to a second embodiment will be described.

Figure 9:
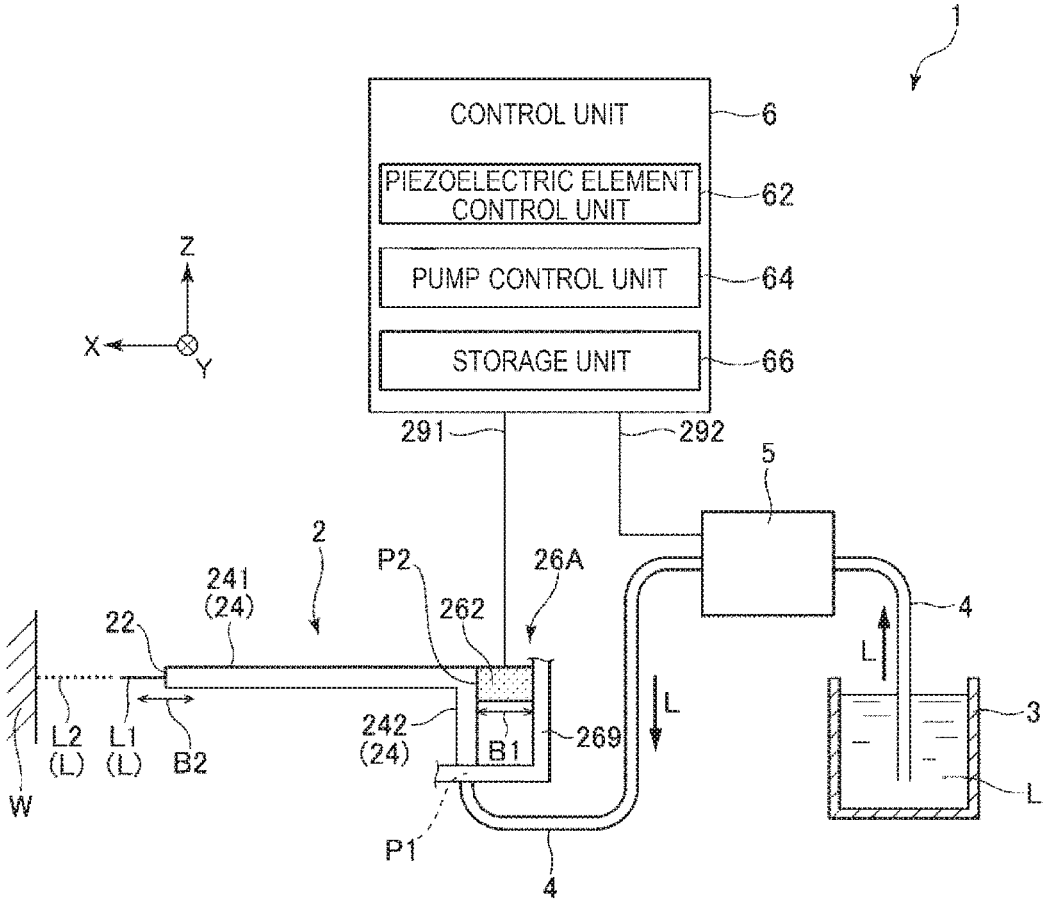
FIG. 9 is a conceptual diagram showing a liquid ejection device according to a second embodiment.

FIG. 9 is a conceptual diagram showing the liquid ejection device according to the second embodiment.

Hereinafter, the second embodiment will be described, and differences from the first embodiment will be mainly described in the following description, and description of similar matters will be omitted. In FIG. 9, the similar components as those in the first embodiment are denoted by the same reference numerals.

The second embodiment is similar to the first embodiment except that a configuration of the nozzle unit 2 is different.

Specifically, in the vibration generation unit 26 according to the first embodiment, the pulsation flow is generated in the liquid L via the diaphragm 264. In contrast, in a vibration generation unit 26A according to the present embodiment, the diaphragm 264 is omitted. Specifically, the vibration generation unit 26A shown in FIG. 9 includes the piezoelectric element 262 and a support 269.

In the liquid transfer tube 24 shown in FIG. 9, the base end portion is bent toward the Z-axis negative side. Accordingly, the liquid transfer tube 24 shown in FIG. 9 includes an X-axis extending portion 241 extending along the X axis, which is a portion on the tip end side, and a Z-axis extending portion 242 extending along the Z axis, which is a portion on the base end side.

The vibration generation unit 26A shown in FIG. 9 is configured to press an outer surface of an end portion on a Z-axis positive side of the Z-axis extending portion 242. Specifically, the piezoelectric element 262 is provided between the outer surface of the Z-axis extending portion 242 and the support 269. That is, the vibration generation unit 26A is in contact with the liquid transfer tube 24 and the support 269. Then, the vibration generation unit 26A vibrates the liquid transfer tube 24 in the transfer direction of the liquid L.

The support 269 is an independent member from the liquid transfer tube 24. When the piezoelectric element 262 expands and contracts along the X axis, that is, vibrates as indicated by an arrow B1 in FIG. 9, the Z-axis extending portion 242 also swings along the X axis. Accordingly, the X-axis extending portion 241 and the nozzle 22 which are continuous with the Z-axis extending portion 242 also swing along the X-axis, that is, as indicated by an arrow B2 in FIG. 9. As a result, the liquid L ejected from the nozzle 22 is ejected along with the pulsation flow accompanied by the swing.

Here, similarly to the first embodiment, the drive frequency fD of the piezoelectric element 262 is also set to be equal to or less than the droplet frequency fL in the present embodiment. By optimizing such a drive frequency fD, the pulsation flow having an appropriate frequency can be generated. Accordingly, the droplet diameter d, which is a diameter of the droplet L2, can be enlarged, and the operation efficiency accompanied by the collision of the droplets L2 can be increased.

One end of the piezoelectric element 262 may be in contact with the outer surface of the Z-axis extending portion 242. Therefore, a link state between the one end of the piezoelectric element 262 and the Z-axis extending portion 242 may be a fixed state such as adhesion or fixation, or may be a mere contact.

On the other hand, a link state between the other end of the piezoelectric element 262 and the support 269 is appropriately selected according to the link state between the one end of the piezoelectric element 262 and the Z-axis extending portion 242 described above. For example, when the one end of the piezoelectric element 262 and the Z-axis extending portion 242 are fixed, at least the other end of the piezoelectric element 262 and the support 269 may be in contact with each other. In addition, when the one end of the piezoelectric element 262 is simply in contact with the Z-axis extending portion 242, the other end of the piezoelectric element 262 and the support 269 are preferably fixed.

The support 269 only needs to have such rigidity that the support 269 does not deform even under a pressure when the piezoelectric element 262 expands and contracts. Accordingly, a large amount of expansion and contraction of the piezoelectric element 262 can be used for swinging the liquid transfer tube 24. An arrangement and shape of the support 269 are not particularly limited.

When the outer surface of the Z-axis extending portion 242 is pressed by the piezoelectric element 262 and the vibration is generated, the nozzle 22 also swings along the X axis. In the present embodiment, as shown in FIG. 9, the piezoelectric element 262 is in contact with the end portion on the Z-axis positive side of the Z-axis extending portion 242. On the other hand, an end portion on a Z-axis negative side of the Z-axis extending portion 242 is fixed to the support 269. In the nozzle unit 2 configured as described above, the liquid transfer tube 24 and the nozzle 22 can swing with a fixed portion of the support 269 serving as a fulcrum P1, and a portion in contact with the piezoelectric element 262 serving as a force point P2. In this case, since a position of the force point P2 is separated from the fulcrum P1, the nozzle 22 can be sufficiently displaced by using an elasticity of the liquid transfer tube 24. Accordingly, the droplet diameter d can be enlarged more easily, and the operation efficiency accompanied by the collision of the droplets L2 can be increased.

Also in the second embodiment as described above, the similar effect as that of the first embodiment can be obtained.

2.1 First Modification

Here, a first modification of the second embodiment will be described.

Figure 10:
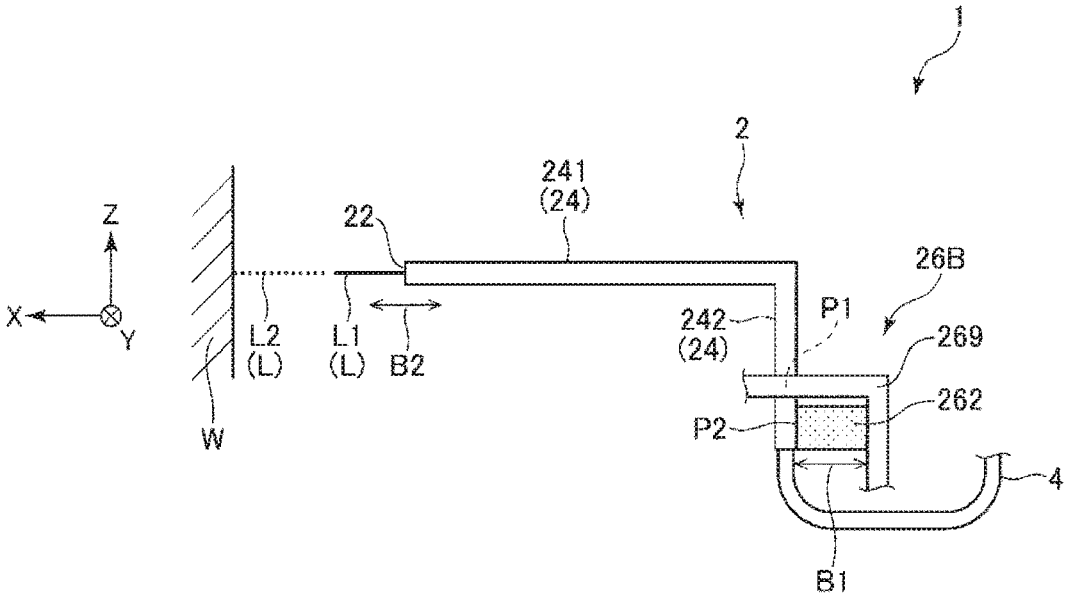
FIG. 10 is a cross-sectional view showing a first modification of the liquid ejection device according to a second embodiment.

FIG. 10 is a cross-sectional view showing the first modification of the liquid ejection device 1 according to the second embodiment. Hereinafter, the first modification will be described, and differences from the second embodiment will be mainly described in the following description, and description of similar matters is omitted.

In the second embodiment described above, as shown in FIG. 9, the piezoelectric element 262 is provided at the end portion on the Z-axis positive side of the Z-axis extending portion 242. On the other hand, in the first modification, as shown in FIG. 10, the piezoelectric element 262 is provided at the end portion on the Z-axis negative side of the Z-axis extending portion 242. That is, a vibration generation unit 26B according to the first modification includes the piezoelectric element 262 which is provided at a position different from that in the second embodiment. In addition, a portion between the end portion on the Z-axis positive side and the end portion on the Z-axis negative side of the Z-axis extending portion 242 is fixed to the support 269. In the nozzle unit 2 configured as described above, when the piezoelectric element 262 vibrates as indicated by an arrow B1 in FIG. 10, a fixed portion of the support 269 serves as the fulcrum P1, and a portion in contact with the piezoelectric element 262 serves as the force point P2, so that the liquid transfer tube 24 and the nozzle 22 are made swing as indicated by an arrow B2 in FIG. 10. In this case, the nozzle 22 is positioned on a side opposite to the force point P2 via the fulcrum P1. A distance between the fulcrum P1 and the nozzle 22 is longer than a distance between the fulcrum P1 and the force point P2. Therefore, even if amplitude of the swing with respect to the force point P2 is small, the amplitude can be amplified and the nozzle 22 can be displaced more greatly. Accordingly, the droplet diameter d can be enlarged more easily, and the operation efficiency accompanied by the collision of the droplets L2 can be increased.

In the first modification as described above, the similar effect as that of the second embodiment can be obtained.

2.2 Second Modification

Next, a second modification of the second embodiment will be described.

Figure 11:
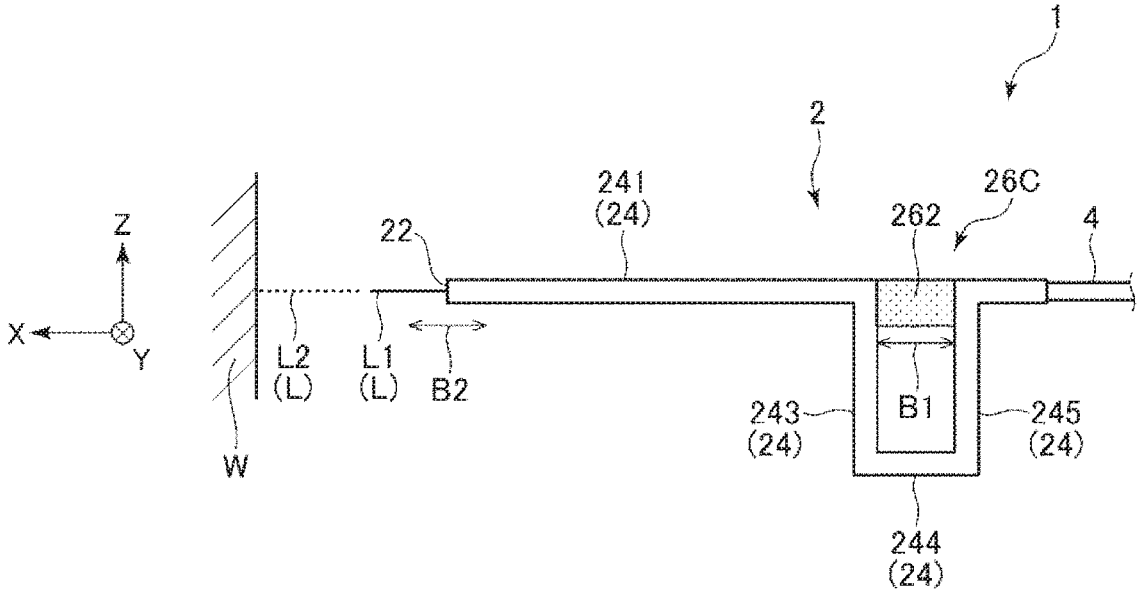
FIG. 11 is a cross-sectional view showing a second modification of the liquid ejection device according to the second embodiment.

FIG. 11 is a cross-sectional view showing the second modification of the liquid ejection device 1 according to the second embodiment. Hereinafter, the second modification will be described, and differences from the second embodiment will be mainly described in the following description, and description of similar matters is omitted.

In the second embodiment described above, as shown in FIG. 9, the piezoelectric element 262 is provided between the Z-axis extending portion 242 and the support 269. On the other hand, in the second modification, as shown in FIG. 11, the liquid transfer tube 24 is flexed so as to sandwich the piezoelectric element 262. Specifically, the liquid transfer tube 24 shown in FIG. 11 includes the X-axis extending portion 241, a first flexing portion 243, a second flexing portion 244, and a third flexing portion 245. Among these portions, the first flexing portion 243 is a portion linked to an end portion on an X-axis negative side of the X-axis extending portion 241 and extending along the Z axis. In addition, the second flexing portion 244 is a portion linked to an end portion on a Z-axis negative side of the first flexing portion 243 and extending along the X axis. Further, the third flexing portion 245 is a portion linked to an end portion on an X-axis negative side of the second flexing portion 244 and extending along the Z axis.

Then, the piezoelectric element 262 is sandwiched between the first flexing portion 243 and the third flexing portion 245. That is, a vibration generation unit 26C according to the second modification includes the piezoelectric element 262 which is fixed by a method different from that of the second embodiment. Accordingly, when the piezoelectric element 262 expands and contracts along the X axis, a displacement amount can be transmitted to the liquid transfer tube 24 without waste. Then, when the piezoelectric element 262 vibrates as indicated by an arrow B1 in FIG. 11, the liquid transfer tube 24 and the nozzle 22 can swing as shown by an arrow B2 in FIG. 11. At this time, the nozzle 22 can be displaced sufficiently large. Since it is not necessary to provide the support 269, a structure of the nozzle unit 2 can be simplified.

In the second modification as described above, the similar effect as that of the second embodiment can be obtained.

2.3 Third Modification

Next, a third modification of the second embodiment will be described.

Figure 12:
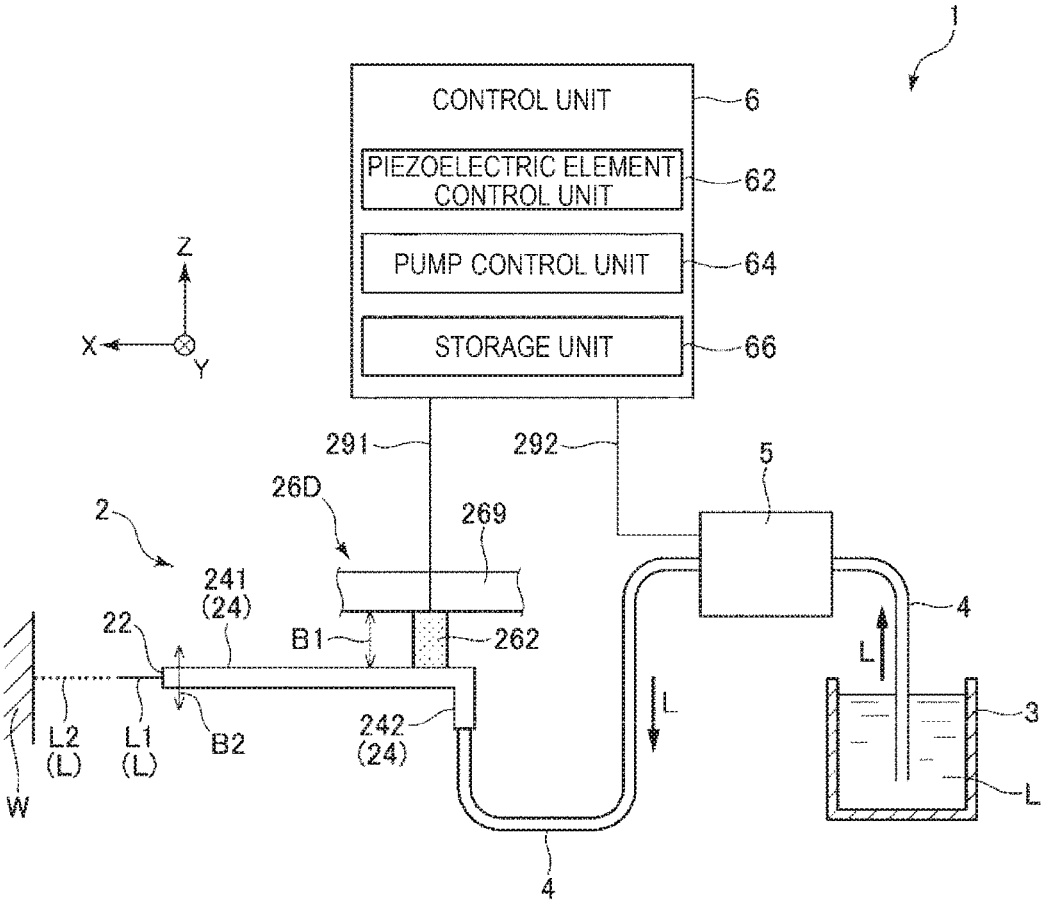
FIG. 12 is a conceptual diagram showing a third modification of the liquid ejection device according to the second embodiment.

FIG. 12 is a conceptual diagram showing the third modification of the liquid ejection device 1 according to the second embodiment. Hereinafter, the third modification will be described, and differences from the second embodiment will be mainly described in the following description, and description of similar matters is omitted.

In the second embodiment described above, as shown in FIG. 9, the piezoelectric element 262 is provided at the Z-axis extending portion 242. On the other hand, in the third modification, as shown in FIG. 12, the piezoelectric element 262 is provided at the end portion on the X-axis negative side of the X-axis extending portion 241. That is, a vibration generation unit 26D according to the third modification includes the piezoelectric element 262 which is provided at a position different from that of the second embodiment, and the vibration generation unit 26D is in contact with the liquid transfer tube 24 and the support 269. The piezoelectric element 262 shown in FIG. 12 vibrates so as to expand and contract along the Z axis, that is, as indicated by an arrow B1 in FIG. 12, and accordingly, the X-axis extending portion 241 and the nozzle 22 also swing along the Z axis as indicated by an arrow B2 in FIG. 12. That is, the vibration generation unit 26D vibrates the liquid transfer tube 24 in a direction orthogonal to the transfer direction of the liquid L. As a result, the liquid L ejected from the nozzle 22 is ejected along with the pulsation flow accompanied by the swing.

Also in the third modification as described above, the similar effect as that of the second embodiment can be obtained.

2.4 Fourth Modification

Next, a fourth modification of the second embodiment will be described.

Figure 13:
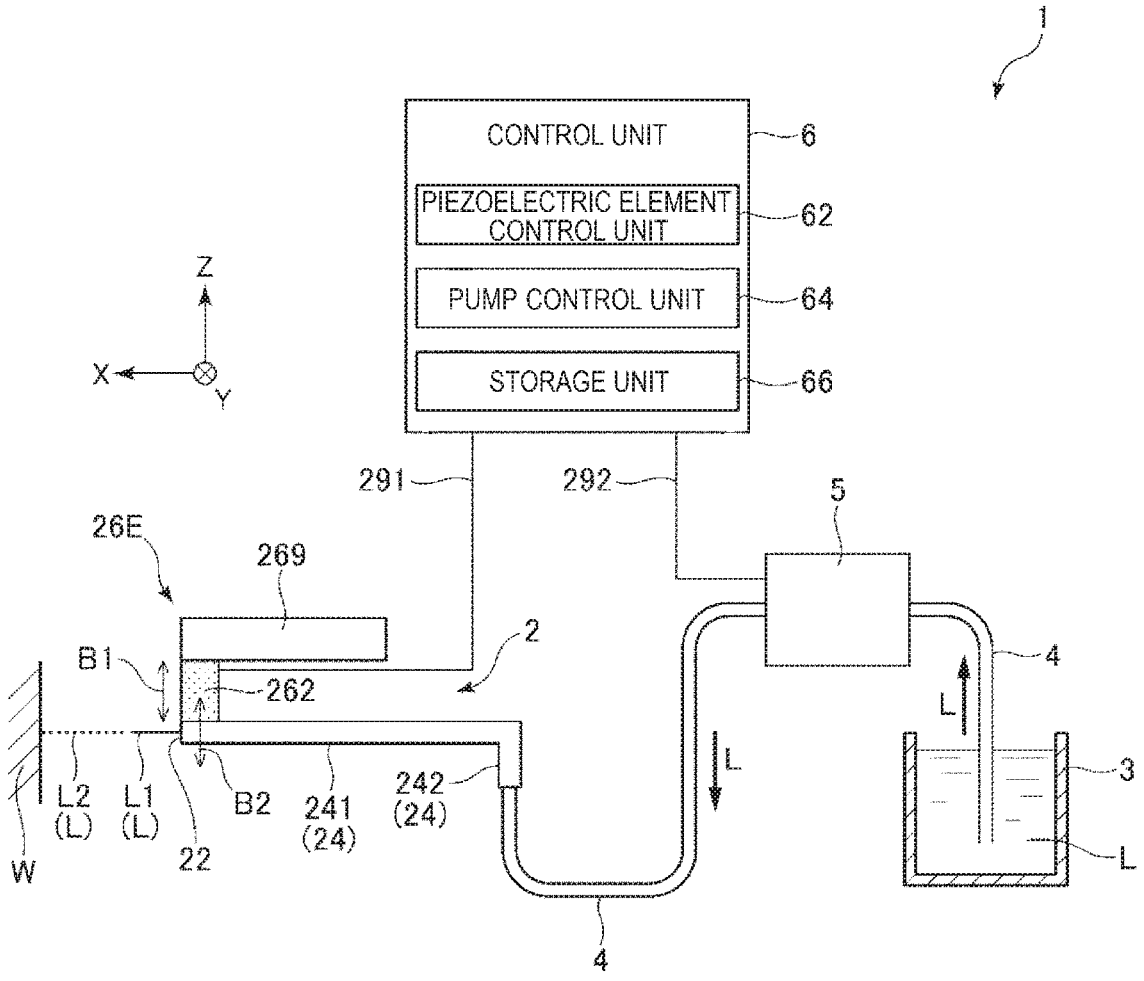
FIG. 13 is a conceptual diagram showing a fourth modification of the liquid ejection device according to the second embodiment.

FIG. 13 is a conceptual diagram showing the fourth modification of the liquid ejection device 1 according to the second embodiment. Hereinafter, the fourth modification will be described, and differences from the third modification will be mainly described in the following description, and description of similar matters is omitted.

In the third modification described above, as shown in FIG. 12, the piezoelectric element 262 is provided at the end portion on the X-axis negative side of the X-axis extending portion 241. On the other hand, in the fourth modification, as shown in FIG. 13, the piezoelectric element 262 is provided at an end portion on an X-axis positive side of the X-axis extending portion 241. That is, a vibration generation unit 26E according to the fourth modification includes the piezoelectric element 262 which is provided at a position different from that in the third modification. Specifically, the vibration generation unit 26E is in contact with the nozzle 22. The piezoelectric element 262 shown in FIG. 13 vibrates so as to expand and contract along the Z axis, that is, as indicated by an arrow B1 in FIG. 13, and accordingly, the nozzle 22 also swings along the Z axis as indicated by an arrow B2 in FIG. 13. As a result, the liquid L ejected from the nozzle 22 is ejected along with the pulsation flow accompanied by the swing.

Also in the fourth modification as described above, the similar effect as that of the second embodiment can be obtained.

Although the liquid ejection device according to the present disclosure is described above based on the illustrated embodiments, the present disclosure is not limited to the embodiments.

For example, in the liquid ejection device according to the present disclosure, a configuration of each unit in the embodiments may be replaced with any configuration having a similar function, and any configuration may be added to the configuration in the embodiments.

An arrangement of the vibration generation unit is not limited to the positions of the embodiments described above, and may be any position as long as it is a position at which the vibration can be applied to the liquid transferred through liquid transfer tube. Further, the liquid ejection device according to the present disclosure may include a plurality of vibration generation units. In this case, two or more of the above embodiments may be used in combination.

Further, the liquid ejection device according to the present disclosure may include a suction device configured to suction the ejected liquid. The suction device may include, for example, a suction tube provided in parallel with the liquid transfer tube, a suction pump linked to the suction tube, and a tank that stores the liquid suctioned by the suction tube.

What is claimed is:

1. A liquid ejection device comprising:

a nozzle through which a liquid is ejected;

a liquid transfer tube through which the liquid is transferred to the nozzle; and a vibration generation unit configured to generate vibration, wherein the vibration generation unit is in contact with one of the liquid, the nozzle, and the liquid transfer tube, and when the liquid ejected from the nozzle flies as a plurality of droplets in a state where the vibration generation unit does not generate vibration, and the number of the droplets passing through a predetermined position in a unit time is defined as a droplet frequency, a frequency of the vibration generated by the vibration generation unit is equal to or less than the droplet frequency.

2. The liquid ejection device according to claim 1, wherein the frequency of the vibration generated by the vibration generation unit is 5% or more and 50% or less of the droplet frequency.

3. The liquid ejection device according to claim 1, wherein the frequency of the vibration generated by the vibration generation unit is 5 kHz or more and 15 kHz or less.

4. The liquid ejection device according to claim 1, wherein the vibration generation unit generates vibration that causes the liquid to pulsate in a transfer direction of the liquid.

5. The liquid ejection device according to claim 1, wherein the vibration generation unit vibrates the liquid transfer tube in a transfer direction of the liquid.

6. The liquid ejection device according to claim 1, wherein the vibration generation unit vibrates the liquid transfer tube in a direction orthogonal to a transfer direction of the liquid.

7. The liquid ejection device according to claim 1, wherein the vibration generation unit includes a piezoelectric element.

* * * * *